United States Patent [19]

Dreher

[11] 4,192,712

[45] Mar. 11, 1980

[54] COMBINED BREAKER SIZE PRESS COATER

[75] Inventor: George L. Dreher, Beloit, Wis.

[73] Assignee: Beloit Corporation, Beloit, Wis.

[21] Appl. No.: 860,208

[22] Filed: Dec. 13, 1977

[51] Int. Cl.[2] ..... B05C 1/12; B05C 3/132; B05C 5/02

[52] U.S. Cl. ..... 162/265; 118/206; 118/262; 118/405; 118/414

[58] Field of Search ..... 162/265; 118/262, 405, 118/414, 206; 100/164, 170

[56] References Cited

U.S. PATENT DOCUMENTS

| | | | |
|---|---|---|---|
| 1,623,280 | 4/1927 | Smith et al. | 118/262 X |
| 2,281,294 | 4/1942 | Malkin | 100/164 |
| 2,645,201 | 7/1953 | Muggleton | 118/262 X |
| 2,729,192 | 1/1956 | Warner | 118/405 X |
| 2,830,555 | 4/1958 | Barrett | 118/262 X |
| 2,920,698 | 1/1960 | Hornbostel | 162/265 |
| 3,044,440 | 7/1962 | Molsberry et al. | 118/262 X |
| 3,276,102 | 10/1966 | Justus | 100/170 X |
| 3,293,067 | 12/1966 | Streb et al. | 118/206 X |

*Primary Examiner*—Richard V. Fisher

*Attorney, Agent, or Firm*—Hill, Van Santen, Steadman, Chiara & Simpson

[57] ABSTRACT

A paper web processing mechanism for applying a combined breaker press and size press coating operation including a first breaker nip formed between a first hard surfaced chilled iron roll and a second coating roll with the first roll being loaded to control the nip pressure and a third roll forming a coating nip with said second roll with the web led immediately through the second nip either by following the second roll or being passed over a guide roll therebetween and the web coated as it passes into the second nip in either a gate roll coating operation by gate rolls nipped against the third roll or by a puddle coating operation with coating supplied to the upwardly facing side of the second nip.

9 Claims, 3 Drawing Figures

COMBINED BREAKER SIZE PRESS COATER

BACKGROUND OF THE INVENTION

This invention relates to improvements in paper processing machines such as in a paper making machine or a paper converting machine where the continuously traveling web is coated and particularly to where the web passes through a breaker nip and a coating nip with the operation of the breaker stack combined with the operation of a coating press in a combined unit apparatus.

Paper webs containing ground wood will require, if they are to be sized or precoated, that they first be passed through a breaker stack with chilled iron rolls. There is a current substantial trend toward replacing traditional 100% chemical furnish sheets with sheets containing various percentages of ground wood due to the lower furnish costs and also due to the higher yield from the wood and the possibility of using lighter basis weights for a given sheet caliper. For example, in computer printout paper, webs which were traditionally chemical furnish sheets have been used now containing on the order of 70% ground wood and 30% long fiber stock. This type of web requires passing through a size press before the final converting operation.

The reason for the requirement of the breaker press operation is that this results in a smoother sheet which will help control size pick-up and have increased ink hold-out. The web which has been passed through the breaker press also has the advantage of reducing fiber picking on the size press size applicator rolls which has been a problem with ground wood sheets.

Conventional breaker stacks employ 4 to 6 chilled iron rolls located between the top dryer can and the size press. These breaker press rolls require operational space and involve an open draw between the breaker press and the following size press. They also involve cost of construction and operation and provide operational hazards to the extent that the operator must be concerned with the mechanism during threading and tending of the machine.

It is an object of the present invention to provide an improved mechanism which will provide a combined breaker and coating or sizing operation avoiding disadvantages present with equipment heretofore available for those operations.

A further object of the invention is to provide an apparatus for a combined breaker stack and size press or coating operation reducing the overall space required for equipment heretofore available, reducing operational hazards to the machine tender or operator, reducing the expense of equipment needed, and reducing the parts and rolls required for the mechanism.

A still further object of the invention is to provide a breaker press and coating mechanism which will provide an improved web of paper eliminating the need for open draws or the length of draws necessary and providing for coating immediately following the breaker press operation reducing the time elapsed between the application of a breaker press into the web and the application of coating or sizing.

Other objects and advantages and features as well as equivalent structures and methods which are intended to be covered herein will become apparent with the teaching of the principles of the present invention in connection with the disclosure embodiments in the specification, claims and drawings, in which:

DRAWINGS

DESCRIPTION

Figure 1:
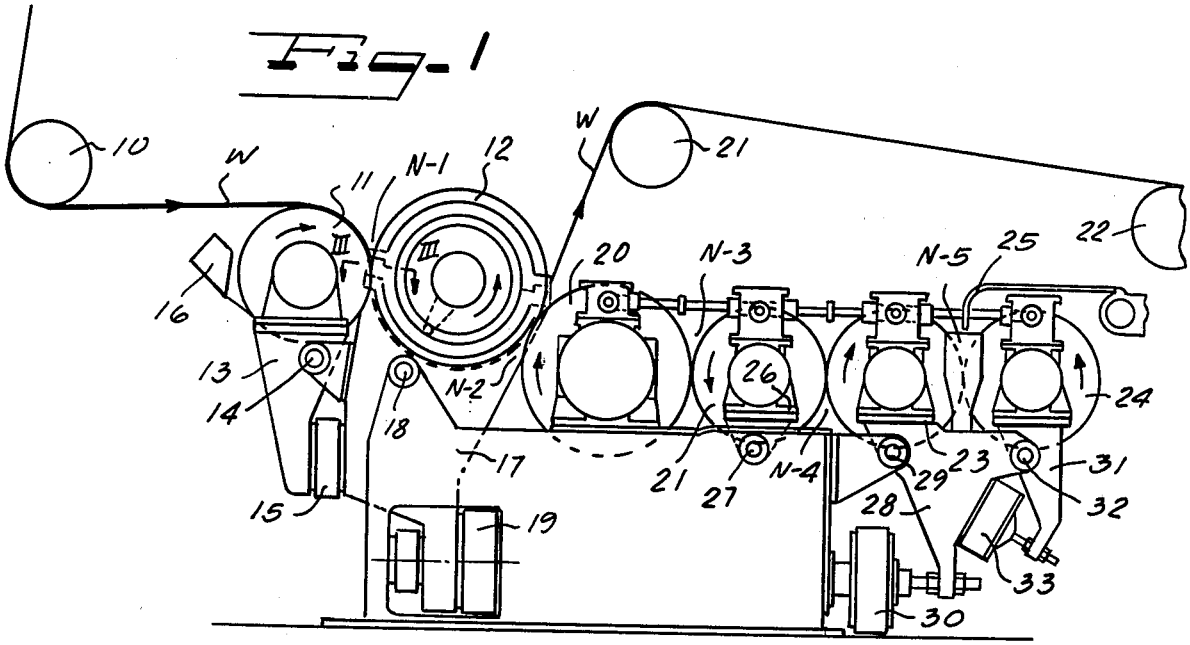
FIG. 1 is a front elevational view, shown somewhat in schematic form, of a mechanism constructed and operating in accordance with the principles of the present invention.

As illustrated in FIG. 1, a continuous traveling paper web W is supplied from a source either from an unwind roll as in a converting machine, or from the dryer section of a continuous operation paper making machine, and the web passes over a guide roll 10 into a breaker press nip N-1.

Figure 3:
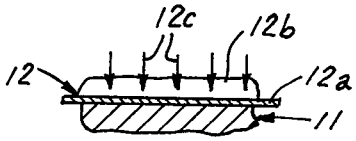
FIG. 3 is a somewhat schematic sectional view taken substantially along line III—III of FIG. 1.

The breaker press nip is formed between a chilled iron roll 11 and a stainless steel variable crown roll 12. As illustrated in the fragmentary sectional view of FIG. 3, the variable crown roll, while it may take various constructions, may be of the type shown in the Justus U.S. Pat. No. 3,276,102. The stainless steel roll 12 has a roll shell **12*a* with a nip controlling pressure shoe 12*b* within the roll shell 12*a* opposite the nip. Radial pressure shown schematically in the form of the arrows 12*c*** applied to the shoe controls the pressure in the nip.

As illustrated in FIG. 1, the web after passing through the nip N-1 and receiving the breaker stack pressing operation immediately passes into a second coating nip N-2, traveling along the surface of the second roll 12 between the two nips. In being so controlled the web does not have to pass through a complete open draw following the separate breaker stack as is normal in operation with devices heretofore available which devices had the hazards of threading a separate breaker stack and a separate coater and with this combined operation, the sheet can be threaded by using carrier ropes in the conventional manner. It is also believed that an improved result occurs in reducing the amount of time between the breaker stack operation and coating or sizing operation with the effect of the breaker operation on the web being better retained if the coating can be applied as soon thereafter as possible.

For controlling the breaker operation in the nip N-1, the pressure in the nip is regulated by the chilled iron breaker roll 11 being mounted on a pivotal arm 13 pivoted at 14 with a force being applied to the arm by an air bellows 15.

The pivot point 14 is so arranged that it is at one side of the bearings for the chilled iron roll so that the weight of the breaker stack will cause the nip to fall open when air is released from the bellows 15.

On the offrunning side following the nip of the breaker roll 11 is located a doctor 16 which keeps the chilled iron breaker roll clean and prevents sheet wrap-ups in the event of paper web break following the breaker nip.

The size press coating nip N-2 is formed between the coating roll 12 and a third roll 20. For regulating the pressure in the nip N-2, the second roll 12 is mounted on bearings on an arm 17 pivoted at 18 and an air bellows 19 operates the arm to control the pressure in the nip N-2, in the range of 50 to 350 PLI. Following the nip, the web passes upwardly over guide rolls 21a and 22.

In the operation as shown in FIG. 1, the lower side or wire side of the web is coated first. The wire side has a higher absorptive rate and results in less picking on the supercalender rolls in a subsequent finishing operation. If the top side is coated first, the fibers are believed to pick up an excess of coating which tends to flake off in later operations. The difference in absorptive rates of the two sides of the paper web is due to it being formed on an open fourdrinier wire with a greater amount of fines being collected on the upper surface of the wire due to the one direction drainage. With webs that are formed on twin wire forming machines such as are known in the art where the stock is directed between two traveling wires and drainage is provided in both directions, the resultant paper web will not be two sided, and the difference in absorption of the two sides of the web will be essentially eliminated so that either side could be coated first.

For the applying the coating or sizing to the underside of the web, it is transferred to the surface of the third roll 20 by size press rolls 21, 23 and 24. These rolls are arranged in horizontal nipped arrangement so that the first size press nip N-3 is formed between the coating roll 20 and the size press roll 21, another transfer nip N-4 is provided between the rolls 21 and 23, and a nip N-5 is formed between the rolls 23 and 24. In the nip N-5 a coating supply is provided by conduits 25 in a measured amount. Control of the quantity of transfer of coating to the roll 20 and hence to the web passing through the nip N-2 is regulated by pressure in the size roll nips N-3, N-4 and N-5. For this purpose, the size press roll 23 is mounted on an arm 28 pivoted at 29 and a controllable air bellows 30 applies a force to the arm 28 to control the pressure in the nip N-4.

The size press roll 24 is mounted on a swing arm 31 pivoted at 32 and an air bellows 33 applies a force to arm to control the pressure in the nip N-5.

Figure 2:
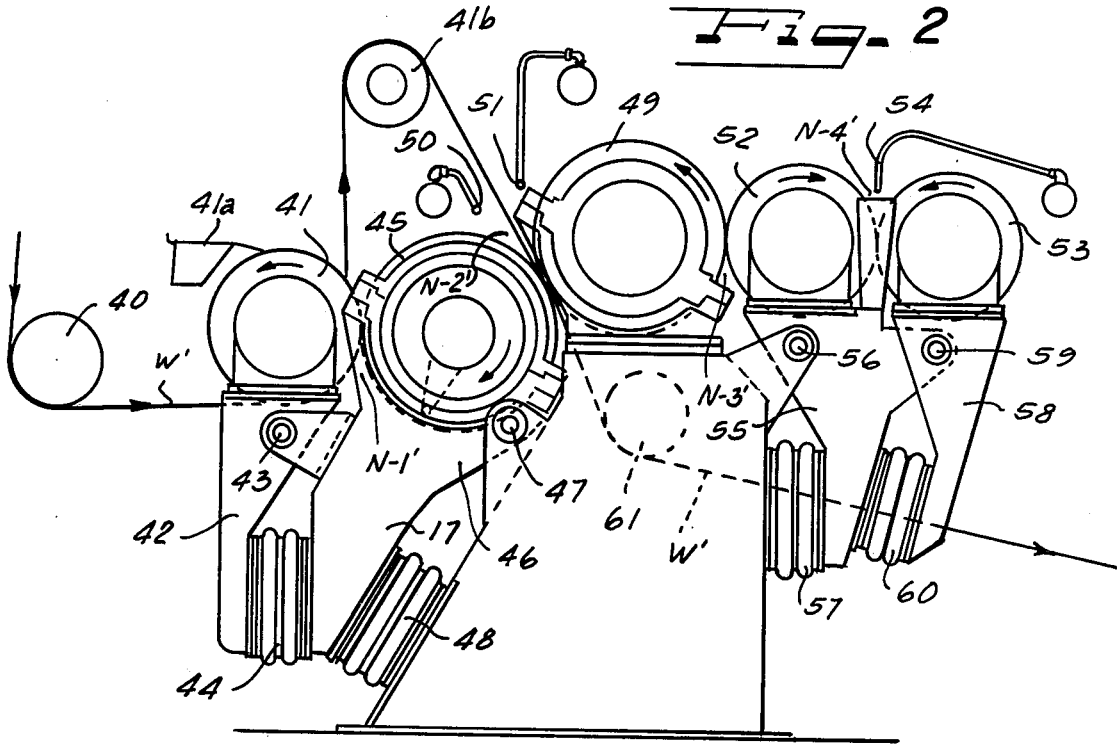
FIG. 2 is another front elevational view of a somewhat modified arrangement also embodying the principles of the invention.

In the arrangement shown in FIG. 2, the structure is arranged in accordance with the principles of the invention, but the apparatus permits coating both sides of the web following the size press. The web W' is supplied continuously over a guide roll 40 into a first nip N-1' where the breaker press operation occurs. The nip N-1' is formed between a chilled iron breaker roll 41 and a stainless steel roll 45. Following the size press, a doctor 41a is applied to the chilled iron roll. To control the pressure in the first press nip N-1', the chilled iron roll is mounted on a swing arm 42 pivoted at 43 with a force applied to the arm by an air bellows 44. the bellows is constructed so as to obtain a pressure in the nip N-1', in the range of 0 to 400 pounds per lineal inch. This capacity is similar to the capacity of the structure of FIG. 1 where the bellows 15 is arranged to obtain a pressure in the nip N-1 in the same range.

As shown in FIG. 2, immediately following the nip N-1' the web is passed upwardly over a guide roll 41b and passed into the second nip or coating nip N-2'. A coating nip N-2' is formed between the roll 45 and a third roll or coating roll 49. The web passes downwardly into the second nip N-2', and the nip acts as a puddle coater with coating being applied to both sides of the web simultaneously through puddle coating supply tubes 50 and 51.

Following the coating nip N-2', the web is led out of the second nip over a guide roll 61.

The structure of FIG. 2 can also readily be employed as a measured or controlled size press coater for applying sizing to the upper side of the web by the size press. This arrangenent may be used to apply sizing to the upper side of the web alone in the nip N-2' or sizing can be applied to the upper side of the web while simultaneously supplying coating to the underside of the web by the puddle coating supply 50.

For applying a layer of size to the upper side of the web, the coating is transferred to the roll 49 through metering size press rolls 52 and 53. The supply of sizing is supplied through a tube 54 into the fourth nip N-4'. The metered coating is carried on the surface of the roll 52 and transferred to the roll 49 at the nip N-3'.

For controlling pressures in the size roll nips, the size roll 52 is supported on a swing arm 55 mounted at pivot points 56 and loading force is applied to the aarm 55 by an air bellows 57.

The size roll 53 is supported on a swing arm 58 pivoted at 59, and a nip loading force is applied to the arm by an air bellows 60.

In operation of the structure of FIG. 2, the web W' is continuously fed into a first nip N-1 between the chilled iron roll 41 and the stainless steel roll 45, and the web then is immediately threaded down into the coating nip N-2 between rolls 45 and 49 where it is coated by a puddle coating operation on both sides, or by size press metering operation to the upper side which may, if desired, be accompanied by the puddle coating application through the line 50 to the lower side. The breaker press operation is immediately followed by a coating operation and the units effect a more rapid handling of the paper and avoids the necessity of open draws utilizing a fewer number of rolls and equipment requiring less size and space.

In FIG. 2, if only a gate roll coating application were to be used, the web run would more than likely follow the roll surface into the nip like FIG. 1 and bypass the guide roll 41b.

The principles of the invention are also applicable to paper machines running both ground wood sheets such as telephone directory and catalog as well as wood-free sheets such as bond and offset. In this case, the ground wood grades would require the use of the breaker stack, but not the size press. The wood-free grades would require the use of the size press but not the breaker.

I claim as my invention:

1. In a paper web processing machine, the combination comprising:

means for supplying a continuous traveling paper web;

a breaker press having a breaker nip formed between a first roll and a second roll, said first and second rolls having smooth metal surfaces for performing a breaker press operation for smoothing and laying down the fibers on the web;

means for controlling the nip pressure between said rolls;

a third roll forming a coating nip with said second roll with said web passing through said coating nip immediately following the breaker nip;

and a coating supply means applying coating to at least one surface of the web as it moves into said coating nip.

2. A paper web processing mechanism constructed in accordance with claim 1:

wherein said first roll is a chilled iron roll.

3. A paper web processing mechanism constructed in accordance with claim 1:

wherein said second roll is a hollow roll shell with means within the roll shell for controlling the pressure along said coating nip, and said second roll has a stainless steel outer nip surface.

4. A paper web processing mechanism constructed in accordance with claim 1:

wherein said means for controlling the nip pressure includes a fluid pressure roll loading means having a loading range for providing a nip pressure in the range of 0 pounds per linear to 400 pounds per linear inch for providing the breaker press effect on the traveling paper web.

5. A paper web processing mechanism constructed in accordance with claim 1:

wherein means is provided for controlling the nip pressure between said second and third rolls having a pressure range for a nip pressure of from 50 to 350 pounds per linear inch in the second nip.

6. In a paper web processing machine, the combination comprising:

means for supplying a continuous traveling paper web;

a breaker press having a breaker nip formed between a first hard surface chilled iron roll and a second stainless steel roll so that the web passed therethrough is smoothed and the fibers laid down;

means for applying a loading force to the first roll for controlling the nip pressure between the rolls;

a third roll forming a coating nip with said second roll with said web passing through the breaker nip and being supported on the surface of the second roll in continual travel through the coating nip;

means for leading the web away from said coating nip;

and means for applying coating to the surface of the third roll for said coating being applied to the traveling web as it moves into the coating nip.

7. A paper web processing mechanism constructed in accordance with claim 6:

wherein said means for applying coating to the third roll includes a gate roll structure with a first gate roll nipped with the third roll, a second gate roll nipped with the first gate roll and a third gate roll nipped with the second gate roll;

means for delivering coating into the nip between the second and third gate rolls;

and means for loading the nips between said gate rolls and controlling the pressures therein.

8. In a paper web processing mechanism, the combination comprising:

means for supplying a continuously traveling paper web;

a breaker press having a breaker nip formed between a first hard surfaced chilled iron roll and a second stainless steel roll;

means for loading the first roll to control the pressure in the nip therebetween;

a third roll forming a coating nip with said second roll with said web passing through said coating nip following the breaker nip; p1 a guide roll receiving the web between said breaker and coating nip and leading the web in a path away from the second roll between the breaker and coating nip;

and a puddle coater coating supply means for supplying coating into said coating nip on at least one side of the web.

9. A paper web processing mechanism constructed in accordance with claim 8:

including first and second size rolls forming a sizing nip therebetween with means for supplying coating between the size rolls and the first size roll being in nipped relationship with said third roll for applying a layer of coating to said third roll to be applied to the web traveling through said coating nip.

* * * * *